US010234159B2

(12) United States Patent
Kobayashi

(10) Patent No.: US 10,234,159 B2
(45) Date of Patent: Mar. 19, 2019

(54) DUCT TYPE AIR CONDITIONING SYSTEM

(71) Applicant: Mitsubishi Electric Corporation, Tokyo (JP)

(72) Inventor: Yuki Kobayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 17 days.

(21) Appl. No.: 15/517,037

(22) PCT Filed: Dec. 11, 2014

(86) PCT No.: PCT/JP2014/082860
§ 371 (c)(1),
(2) Date: Apr. 5, 2017

(87) PCT Pub. No.: WO2016/092671
PCT Pub. Date: Jun. 16, 2016

(65) Prior Publication Data

US 2017/0299211 A1 Oct. 19, 2017

(51) Int. Cl.
*F24F 11/30* (2018.01)
*F24F 11/76* (2018.01)
(Continued)

(52) U.S. Cl.
CPC ..... *F24F 11/30* (2018.01); *F24F 3/044* (2013.01); *F24F 11/62* (2018.01); *F24F 11/76* (2018.01);
(Continued)

(58) Field of Classification Search
CPC .. F24F 3/044; F24F 11/30; F24F 11/54; F24F 11/62; F24F 11/65; F24F 11/76; F24F 2003/0446; F24F 2110/10
See application file for complete search history.

(56) References Cited

U.S. PATENT DOCUMENTS 4,811,897 A 3/1989 Kobayashi et al.
4,829,884 A 5/1989 Kagohata
(Continued)

FOREIGN PATENT DOCUMENTS

AU 2002301200 B2 4/2004
GB 2 261 964 A 6/1993
(Continued)

OTHER PUBLICATIONS

Office Action dated Mar. 27, 2018 issued in corresponding AU patent application No. 2014413429.
(Continued)

*Primary Examiner* — Marc E Norman
(74) *Attorney, Agent, or Firm* — Posz Law Group, PLC

(57) ABSTRACT

A duct type air conditioning system includes an air conditioner; a plurality of ducts that are disposed in a plurality of air-conditioned spaces that are supplied with conditioned air of the air conditioner; a plurality of room temperature sensors that are disposed in the air-conditioned spaces; a control device that controls the air conditioner; and controllers that control the air conditioner. The control device determines a room temperature sensor disposed in any of the air-conditioned spaces on which an air-conditioning starting operation is performed by the controllers by using sensor setting information in which the air-conditioned spaces and the room temperature sensors are associated with each other. The air conditioner includes an air-conditioning control degree calculating unit that calculates a degree of control of the air conditioner on the basis of a room temperature detected by the room temperature sensor determined by the control device.

10 Claims, 12 Drawing Sheets

(51) Int. Cl.

| | |
|---|---|
| ***F24F 11/62*** | (2018.01) |
| ***F24F 3/044*** | (2006.01) |
| *F24F 11/54* | (2018.01) |
| *F24F 110/10* | (2018.01) |
| *F24F 11/65* | (2018.01) |

(52) U.S. Cl.
CPC ..... *F24F 11/54* (2018.01); *F24F 11/65* (2018.01); *F24F 2003/0446* (2013.01); *F24F 2110/10* (2018.01)

(56) References Cited

U.S. PATENT DOCUMENTS

| | | | | |
|---|---|---|---|---|
| 5,303,767 | A | 4/1994 | Riley | |
| 5,344,069 | A | 9/1994 | Narikiyo | |
| 7,775,449 | B2 * | 8/2010 | Garozzo | F24F 11/30 236/1 B |
| 2013/0014927 | A1 | 1/2013 | Dazai | |

FOREIGN PATENT DOCUMENTS

| | | | |
|---|---|---|---|
| JP | 61-107410 | A | 5/1986 |
| JP | 04-055653 | A | 2/1992 |
| JP | 05-106905 | A | 4/1993 |
| JP | 06-101897 | A | 4/1994 |
| JP | 06-317335 | A | 11/1994 |
| JP | 07-049144 | A | 2/1995 |
| JP | 08-505937 | A | 6/1996 |
| JP | 08-261545 | A | 10/1996 |
| JP | 09-126523 | A | 5/1997 |
| JP | 10-132363 | A | 5/1998 |
| JP | 63-263125 | A | 10/1998 |
| JP | 2001-091036 | A | 4/2001 |
| JP | 2004-239580 | A | 8/2004 |
| JP | 2004-279000 | A | 10/2004 |
| JP | 2009-150590 | A | 7/2009 |
| JP | 2012-156952 | A | 8/2012 |
| JP | 2013-231549 | A | 11/2013 |
| JP | 2014-077598 | A | 5/2014 |

OTHER PUBLICATIONS

International Search Report of the International Searching Authority dated Mar. 17, 2015 for the corresponding international application No. PCT/JP2014/082860 (and English translation).

Extended European Search Report dated Dec. 19, 2016 issued in corresponding EP patent application No. 14897425.6.

Office Action dated Jan. 9, 2018 issued in corresponding JP patent application No. 2016-563354 (and English machine translation thereof).

Office Action dated Sep. 24, 2018 issued in corresponding AU patent application No. 2014413429.

Office action dated Jun. 19, 2018 issued in corresponding JP patent application No. 2016-563354 (and English translation thereof).

* cited by examiner

FIG.4

421

| AIR-CONDITIONED SPACE | ROOM TEMPERATURE SENSOR |
|---|---|
| 10-1 | 11-1 |
| 10-2 | 11-2 |
| 10-3 | 11-3 |
| 10-4 | 11-4 |

| AIR-CONDITIONED SPACE | ROOM TEMPERATURE SENSOR | ROOM TEMPERATURE | AIR-CONDITIONING STARTING OPERATION |
|---|---|---|---|
| 10-1 | 11-1 | 24°C | ON |
| 10-2 | 11-2 | 25°C | OFF |
| 10-3 | 11-3 | 26°C | ON |
| 10-4 | 11-4 | 27°C | OFF |

FIG.14

421A

| AIR-CONDITIONED SPACE | ROOM TEMPERATURE SENSOR | PRIORITY LEVEL |
|---|---|---|
| 10-1 | 11-1 | 4(LOW) |
| 10-2 | 11-2 | 3 |
| 10-3 | 11-3 | 2 |
| 10-4 | 11-4 | 1(HIGH) |

DUCT TYPE AIR CONDITIONING SYSTEM

CROSS REFERENCE TO RELATED APPLICATION

This application is a U.S. national stage application of International Patent Application No. PCT/JP2014/082860 filed on Dec. 11, 2014, the disclosure of which is incorporated herein by reference.

TECHNICAL FIELD

The present invention relates to a duct type air conditioning system that supplies conditioned air to a plurality of air-conditioned spaces through a duct connected to an air conditioner.

BACKGROUND

A duct type air conditioning system according to the related art, a representative example of which is described in Patent Literature 1, includes an outdoor unit included in an air conditioner; an indoor unit included in the air conditioner; room temperature sensors; a duct that is connected to the outlet of the indoor unit; a plurality of duct-branch portions that are branching from the duct and disposed in a plurality of air-conditioned spaces; a plurality of dampers that are disposed in the duct-branch portions to open and close air channels in the duct-branch portions; and a plurality of outlets that are disposed at the ends of the duct-branch portions to discharge conditioned air to the air-conditioned spaces. In the duct type air conditioning system according to the related art, air-conditioning of the air-conditioned spaces is performed by opening and closing the dampers.

PATENT LITERATURE

Patent Literature 1: Japanese Patent Application Laid-Open No. H7-49144

The air conditioner that is used in the duct type air conditioning system according to the related art discharges conditioned air in accordance with the temperature differences between the set room temperature set by a user and the room temperatures detected in the air-conditioned spaces. Because the room temperatures detected in the individual air-conditioned spaces are different, the duct type air conditioning system according to the related art cannot supply appropriate conditioned air to the air-conditioned space desired by a user out of the air-conditioned spaces. Accordingly, in order to supply appropriate conditioned air to the air-conditioned space desired by the user out of the air-conditioned spaces, the user has to select the air-conditioned space to be air-conditioned out of the air-conditioned spaces and also has to select a room temperature sensor located in the vicinity of the air-conditioned space to be air-conditioned when the air-conditioned space is air-conditioned. This means that, the duct type air conditioning system according to the related art has a problem in that it has poor user convenience.

SUMMARY

The present invention is made in view of the above and an object of the present invention is to provide a duct type air conditioning system that can achieve an improvement in user convenience.

In order to solve the above problems and achieve the object, a duct type air conditioning system according to the present invention includes: an air conditioner; a plurality of ducts that are disposed in a plurality of air-conditioned spaces that are supplied with conditioned air of the air conditioner; a plurality of room temperature sensors that are disposed in the air-conditioned spaces; a control device that controls the air conditioner; and a controller that controls the air conditioner, wherein the control device determines a room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning control degree calculating unit that calculates a degree of control of the air conditioner on a basis of a room temperature detected by the room temperature sensor determined by the control device.

The duct type air conditioning system according to the present invention exhibits an effect that an improvement in user convenience can be achieved.

BRIEF DESCRIPTION OF DRAWINGS

FIG. 4 is a diagram illustrating an example of a sensor setting table.

FIG. 14 is a diagram illustrating an example of a sensor setting table illustrated in FIG. 13.

DETAILED DESCRIPTION

Hereinafter, a duct type air conditioning system according to embodiments of the present invention will be described in detail with reference to the accompanying drawings. The present invention is not limited to the embodiments.

First Embodiment

Figure 1:
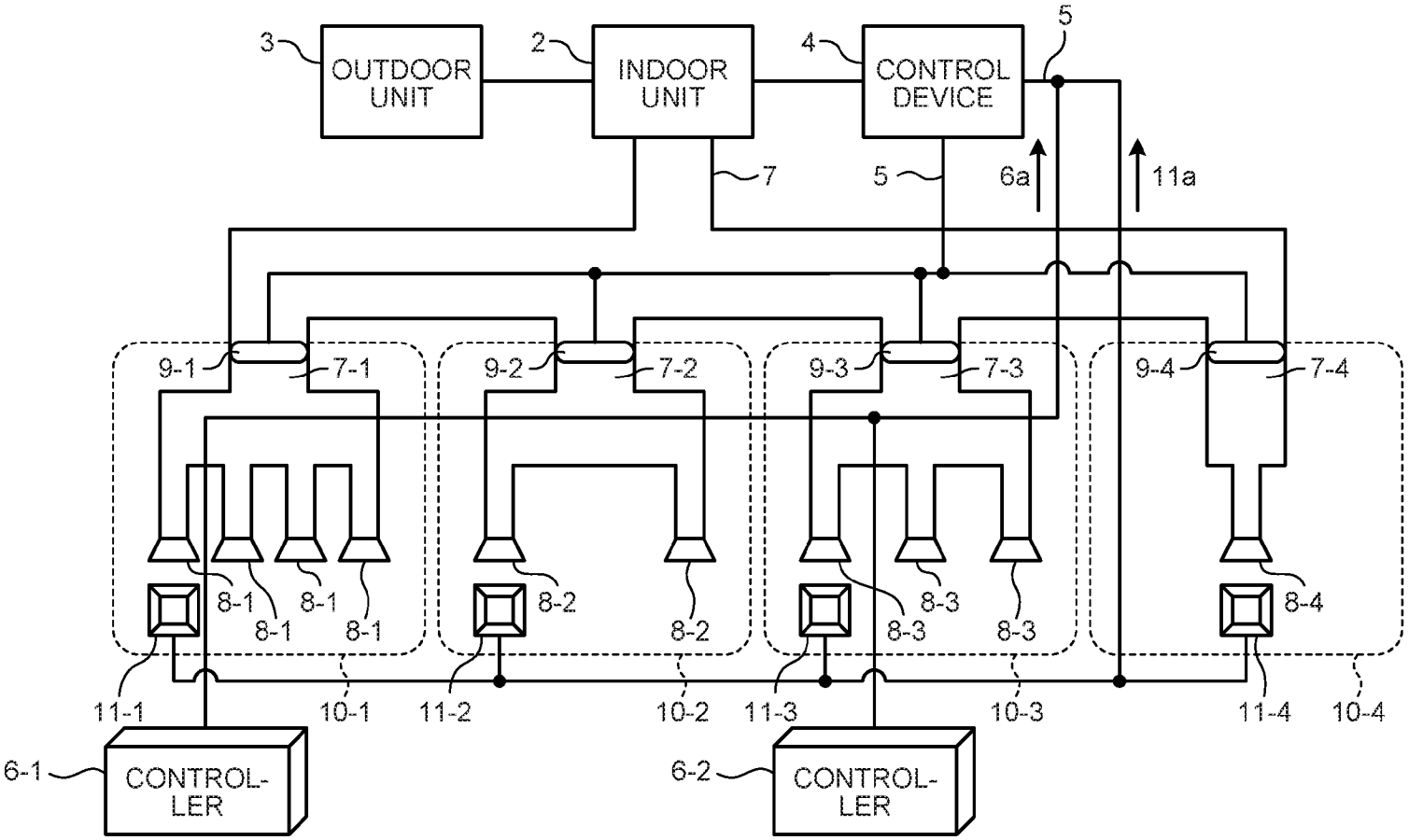
FIG. 1 is a diagram illustrating a configuration of a duct type air conditioning system according to a first embodiment of the present invention.

FIG. 1 is a diagram illustrating a configuration of a duct type air conditioning system according to a first embodiment of the present invention. A duct type air conditioning system 1 includes an indoor unit 2 included in an air conditioner; an outdoor unit 3 that is included in the air conditioner and is connected to the indoor unit 2; a control device 4 that controls the air conditioner; a plurality of controllers 6-1 and 6-2 that transmit various pieces of information to the control device 4 via control lines 5; a duct 7 that supplies conditioned air from the indoor unit 2 to a plurality of air-conditioned spaces 10-1, 10-2, 10-3, and 10-4; a plurality of duct-branch portions 7-1, 7-2, 7-3, and 7-4 that are each branching from the duct 7 and are disposed in the air-conditioned spaces 10-1, 10-2, 10-3, and 10-4; a plurality of dampers 9-1, 9-2, 9-3, and 9-4 that are disposed in the duct-branch portions 7-1, 7-2, 7-3, and 7-4 and that open and close air channels in the duct under the control of the control device 4; a plurality of outlets 8-1, 8-2, 8-3, and 8-4 that are disposed at the ends of the duct-branch portions 7-1, 7-2, 7-3, and 7-4 and that discharge conditioned air to the air-conditioned spaces 10-1, 10-2, 10-3, and 10-4; a room temperature sensor 11-1 that detects the room temperature of the air-conditioned space 10-1; a room temperature sensor 11-2 that detects the room temperature of the air-conditioned space 10-2; a room temperature sensor 11-3 that detects the room temperature of the air-conditioned space 10-3; and a room temperature sensor 11-4 that detects the room temperature of the air-conditioned space 10-4.

The control device 4, the indoor unit 2, the outdoor unit 3, the controllers 6-1 and 6-2, and the dampers 9-1, 9-2, 9-3, and 9-4 are connected via the control lines 5. The opening/closing of the dampers 9-1, 9-2, 9-3, and 9-4 is individually controlled by the control device 4. Room temperature information 11*a* on the room temperatures detected by the room temperature sensors 11-1, 11-2, 11-3, and 11-4 is transmitted to the control device 4 via the control lines 5. The controllers 6-1 and 6-2 perform various settings for individually controlling air-conditioning of the air-conditioned spaces 10-1, 10-2, 10-3, and 10-4 and information indicating setting details is transmitted as controller output information 6*a* to the control device 4.

The duct type air conditioning system illustrated in FIG. 1 employs the control device 4. However, for example, the control device 4 may be configured to be detachable from the air conditioner such that the control device 4 is detached from the air conditioner when it is not necessary to control the dampers 9-1, 9-2, 9-3, and 9-4 and the control device 4 is attached to the air conditioner when it is necessary to control the dampers 9-1, 9-2, 9-3, and 9-4. With this configuration, a duct type air conditioning system in which it is not necessary to control a plurality of dampers can control the air conditioner by using the intake temperature of the indoor unit as a control room temperature; therefore, the same air conditioner can be used in a duct type air conditioning system in which it is not necessary to control a plurality of dampers and thus the air conditioner can be shared. The duct type air conditioning system 1 illustrated in FIG. 1 employs two controllers, four duct-branch portions, and four dampers, but the number of controllers, the number of duct-branch portions, and the number of dampers are not limited to the numbers illustrated in the drawing. The number of outlets disposed in the air-conditioned spaces is not limited to the number illustrated in the drawing. The duct type air conditioning system 1 illustrated in FIG. 1 employs one duct and a plurality of duct-branch portions, but the configuration of the duct is not limited to the configuration illustrated in the drawing. For example, the duct type air conditioning system 1 may be configured to directly supply conditioned air from the indoor unit 2 to the air-conditioned spaces via a plurality of ducts when the ends of the ducts are connected to the indoor unit 2 and the other ends of the ducts are disposed in the air-conditioned spaces. The duct type air conditioning system 1 illustrated in FIG. 1 employs a duct having dampers built therein, but the duct type air conditioning system 1 can control air-conditioning even when a duct not having dampers built therein is used.

Figure 2:
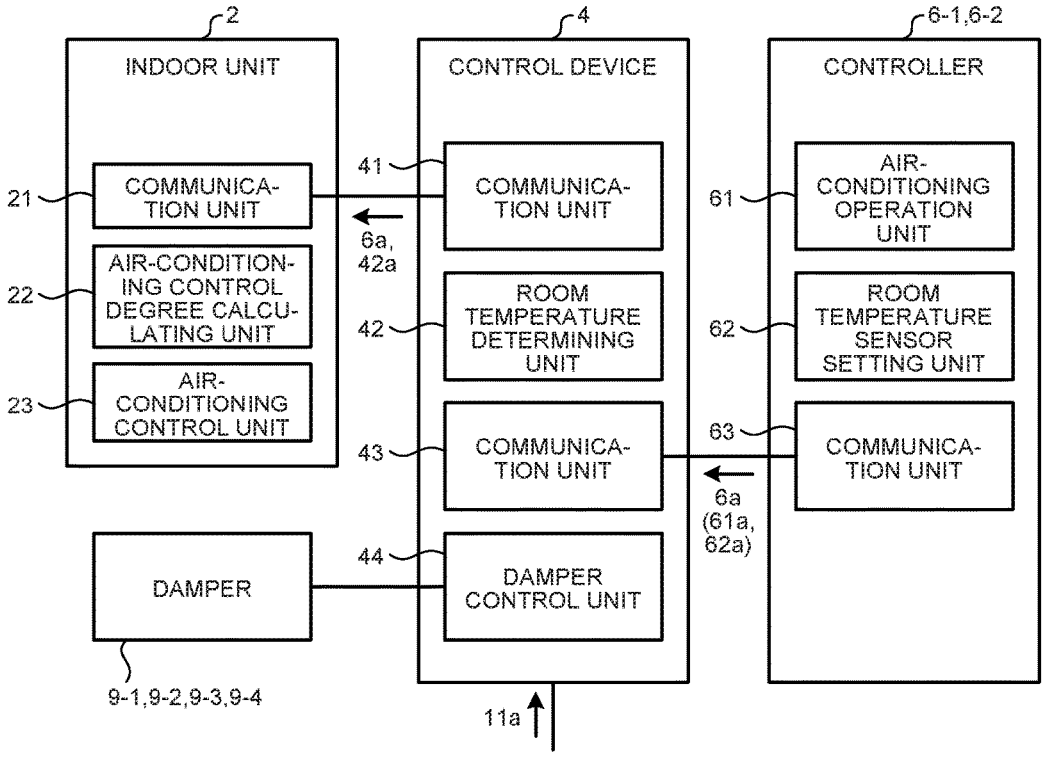
FIG. 2 is a diagram illustrating functional blocks of an indoor unit, a control device, and a controller that constitute the duct type air conditioning system.

FIG. 2 is a diagram illustrating functional blocks of the indoor unit, the control device, and the controller that constitute the duct type air conditioning system. Each of the controllers 6-1 and 6-2 includes an air-conditioning operation unit 61 that performs operations such as an air-conditioning starting operation and a room temperature setting operation for an air-conditioned space that a user wants to air-condition out of the air-conditioned spaces 10-1, 10-2, 10-3, and 10-4; a room temperature sensor setting unit 62 that sets the room temperature sensor used for the air-conditioning control of the air-conditioned space that a user wants to air-condition out of the room temperature sensors 11-1, 11-2, 11-3, and 11-4; and a communication unit 63 that communicates with the control device 4. The control device 4 includes a communication unit 41 that communicates with the indoor unit 2; a room temperature determining unit 42 that determines which room temperature sensor corresponds to the air-conditioned space by using the controller output information 6*a* from the controllers 6-1 and 6-2 and the room temperature information 11*a* from the room temperature sensors and that outputs room temperature information 42*a* on the room temperature detected by the determined room temperature sensor; a communication unit 43 that communicates with the controllers 6-1 and 6-2; and a damper control unit 44 that controls the opening/closing of the dampers 9-1, 9-2, 9-3, and 9-4. The indoor unit 2 includes a communication unit 21 that communicates with the control device 4; an air-conditioning control degree calculating unit 22 that calculates the temperature difference between the temperature determined by the room temperature determining unit 42 and the set temperature of the air-conditioned space by using the room temperature information 42*a* from the room temperature determining unit 42 and the controller output information 6*a* and that determines the degree of air-conditioning control of the air conditioner on the basis of the calculated temperature difference; and an air-conditioning control unit 23 that controls the supply of conditioned air of the indoor unit 2 depending on the degree of air-conditioning control from the air-conditioning control degree calculating unit 22.

When the air-conditioning operation unit 61 performs the air-conditioning starting operation or the room temperature setting operation on the air-conditioned space that a user wants to air-condition, the air-conditioning operation unit 61 generates operation information 61*a* indicating the operation details. When the room temperature sensor setting unit 62 sets the room temperature sensor, the room temperature sensor setting unit 62 generates room temperature sensor setting information 62*a* indicating the set room temperature sensor. The operation information 61*a* and the room temperature sensor setting information 62*a* are transmitted as the controller output information 6*a* to the control device 4 and the indoor unit 2, and the room temperature information 42*a* generated by the room temperature determining unit 42 is transmitted to the indoor unit 2.

Figure 3:
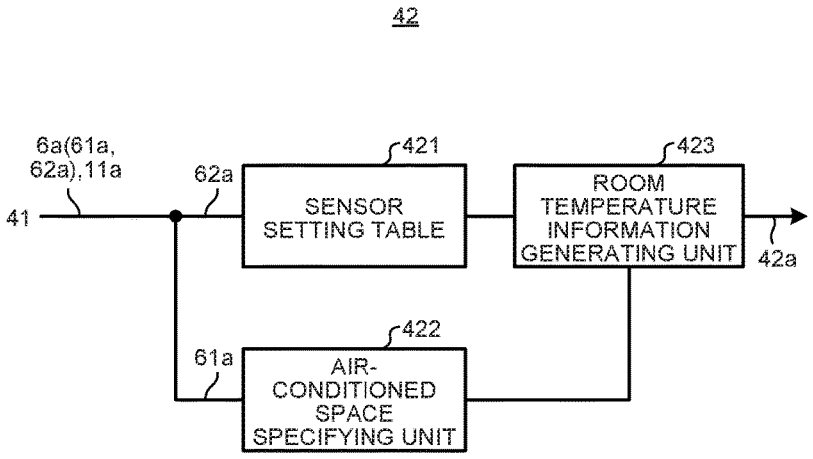
FIG. 3 is a diagram illustrating a functional block of a room temperature determining unit.

FIG. 3 is a diagram illustrating a functional block of the room temperature determining unit. The room temperature determining unit 42 illustrated in FIG. 3 includes a sensor setting table 421, which is sensor setting information that stores the air-conditioned spaces and the room temperature sensors set by the room temperature sensor setting unit 62 in association with each other on the basis of the room temperature sensor setting information 62*a*; an air-conditioned space specifying unit 422 that specifies the air-conditioned space in which air-conditioning is started on the basis of the operation information 61*a*; and a room temperature information generating unit 423 that determines the room temperature sensor corresponding to the air-conditioned space by checking the air-conditioned space specified by the air-conditioned space specifying unit 422 against the sensor setting table 421 and that generates room temperature information on the room temperature detected by the determined room temperature sensor. The sensor setting table 421 is not limited to the one in which the air-conditioned spaces and the room temperature sensors are associated with each other by using the room temperature sensor setting unit 62 and, for example, the sensor setting table 421 may be directly registered in the control device 4 without using the room temperature sensor setting unit 62.

FIG. 4 is a diagram illustrating an example of the sensor setting table. In the sensor setting table 421, for example, the air-conditioned spaces 10-1, 10-2, 10-3, and 10-4 and the room temperature sensors 11-1, 11-2, 11-3, and 11-4 illustrated in FIG. 1 are stored in association with each other. Specifically, in the sensor setting table 421, it is assumed that the air-conditioned space 10-1 and the room temperature sensor 11-1 are associated, the air-conditioned space 10-2 and the room temperature sensor 11-2 are associated, the air-conditioned space 10-3 and the room temperature sensor 11-3 are associated, and the air-conditioned space 10-4 and the room temperature sensor 11-4 are associated.

Figure 5:
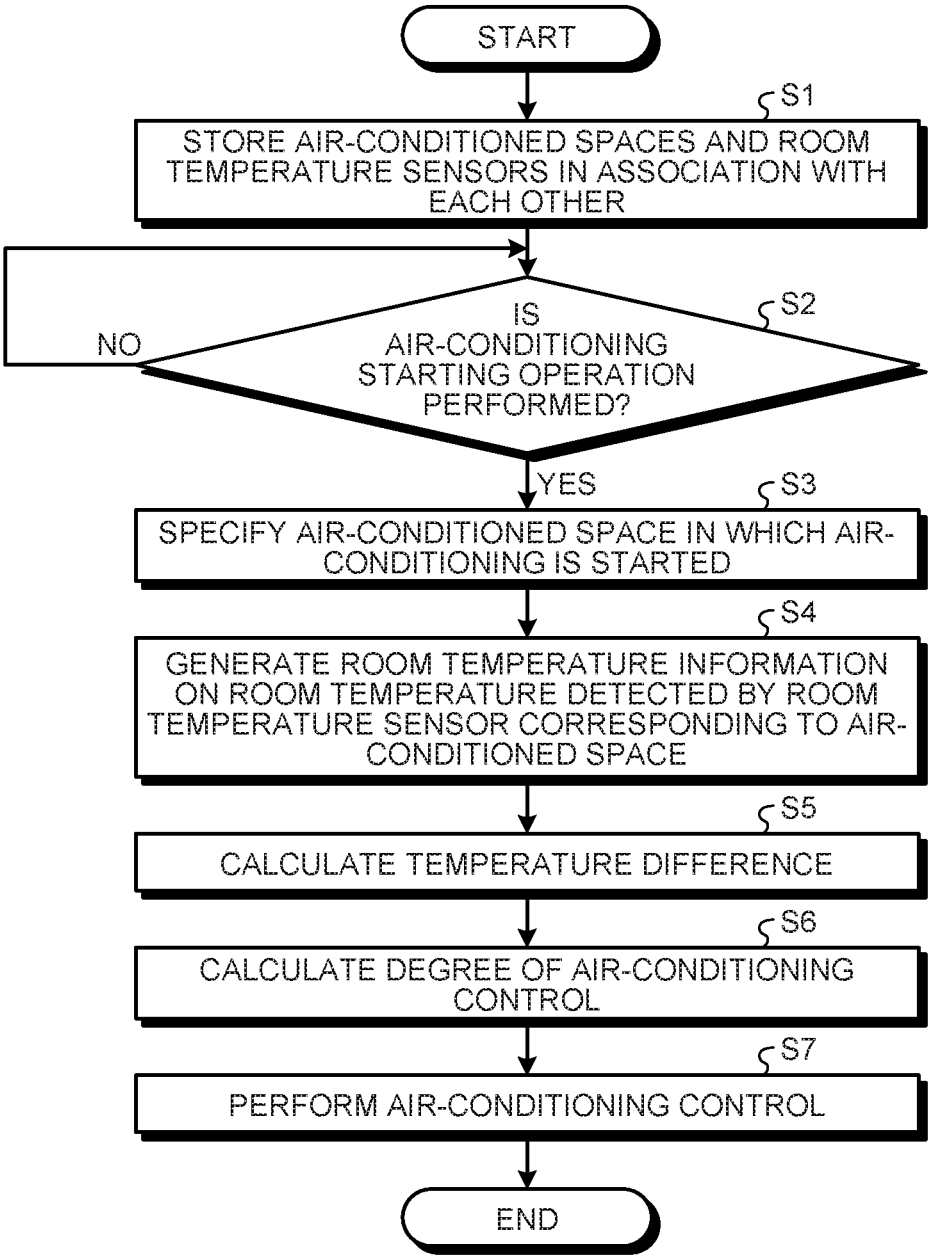
FIG. 5 is a flowchart illustrating operations of the duct type air conditioning system according to the first embodiment of the present invention.

Operations will be described below. FIG. 5 is a flowchart illustrating the operations of the duct type air conditioning system according to the first embodiment of the present invention. The room temperature sensor setting unit 62 performs the operation of setting the room temperature sensor that is used for air-conditioning control of the air-conditioned space that a user wants to air-condition, and thus the air-conditioned spaces and the room temperature sensors set by the room temperature sensor setting unit 62 are stored in association with each other in the sensor setting table 421 (step S1). When the air-conditioning operation unit 61 does not perform the air-conditioning starting operation on the air-conditioned spaces 10-1, 10-2, 10-3, and 10-4 (step S2, No), the air-conditioned space specifying unit 422 continues to perform the process of step S2. For example, when the air-conditioning operation unit 61 performs the air-conditioning starting operation on the air-conditioned space 10-1 (step S2, Yes), the air-conditioned space specifying unit 422 specifies the air-conditioned space in which air-conditioning is started as the air-conditioned space 10-1 (step S3), and the room temperature information generating unit 423 determines the room temperature sensor corresponding to the air-conditioned space by checking the air-conditioned space specified by the air-conditioned space specifying unit 422 against the sensor setting table 421 and generates the room temperature information 42*a* on the room temperature detected by the determined room temperature sensor (step S4). The air-conditioning control degree calculating unit 22 calculates the temperature difference between the room temperature determined by the room temperature determining unit 42 and the set temperature of the air-conditioned space 10-1 by using the room temperature information 42*a* from the room temperature determining unit 42 and the controller output information 6*a* (step S5) and calculates the degree of air-conditioning control of the air conditioner corresponding to the temperature difference (step S6), and the air-conditioning control unit 23 performs the air-conditioning control in accordance with the degree of air-conditioning control (step S7).

In the related art, when air-conditioned spaces are air-conditioned, a user has to select one air-conditioned space to be air-conditioned out of a plurality of air-conditioned spaces and has to select a room temperature sensor located in the vicinity of the air-conditioned space to be air-conditioned. Accordingly, the related art has a problem in that user convenience is poor. In contrast, in the duct type air conditioning system 1 according to the first embodiment, when a plurality of air-conditioned spaces are simultaneously air-conditioned, the room temperature sensor disposed in the air-conditioned space on which the air-conditioning starting operation is performed can be automatically specified and the air-conditioning control can be carried out by using the room temperature detected by the specified room temperature sensor. Accordingly, it is possible to achieve an improvement in user convenience.

Second Embodiment

While the first embodiment describes a configuration example in which the air-conditioning control is carried out when air-conditioning of one air-conditioned space is started, a second embodiment will describe a configuration example in which air-conditioning control is simultaneously performed on a plurality of air-conditioned spaces when air-conditioning of the air-conditioned spaces is started. In the following description, the same elements as in the first embodiment will be referenced by the same reference signs, description thereof will not be repeated, and only differences therebetween will be described below.

Figure 6:
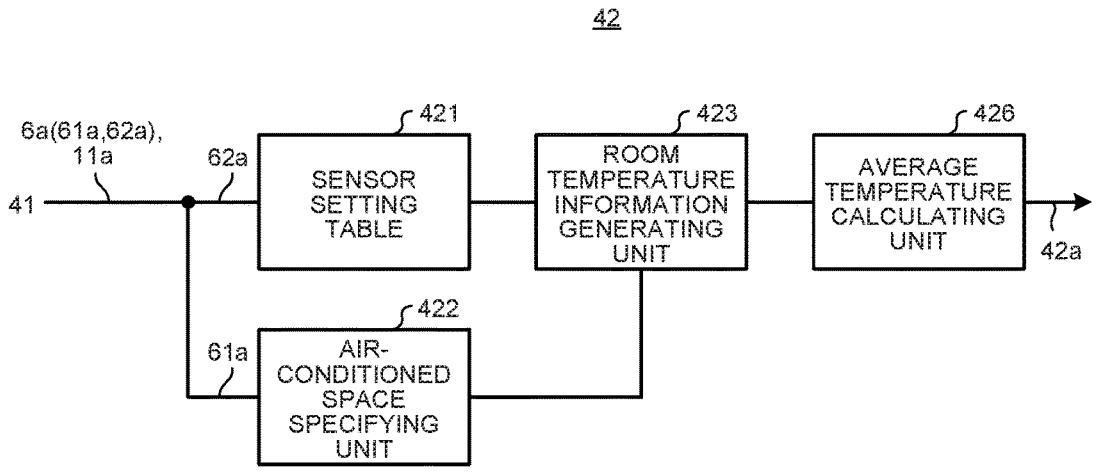
FIG. 6 is a diagram illustrating a functional block of a room temperature determining unit of a duct type air conditioning system according to a second embodiment of the present invention.

FIG. 6 is a diagram illustrating a functional block of a room temperature determining unit of a duct type air conditioning system according to the second embodiment of the present invention. The room temperature determining unit 42 illustrated in FIG. 6 includes the sensor setting table 421, the air-conditioned space specifying unit 422, the room temperature information generating unit 423, and an average temperature calculating unit 426 that calculates the average temperature of the room temperatures detected by the room temperature sensors determined by the room temperature information generating unit 423. The average temperature calculated by the average temperature calculating unit 426 is output as the room temperature information 42*a*.

Figure 7:
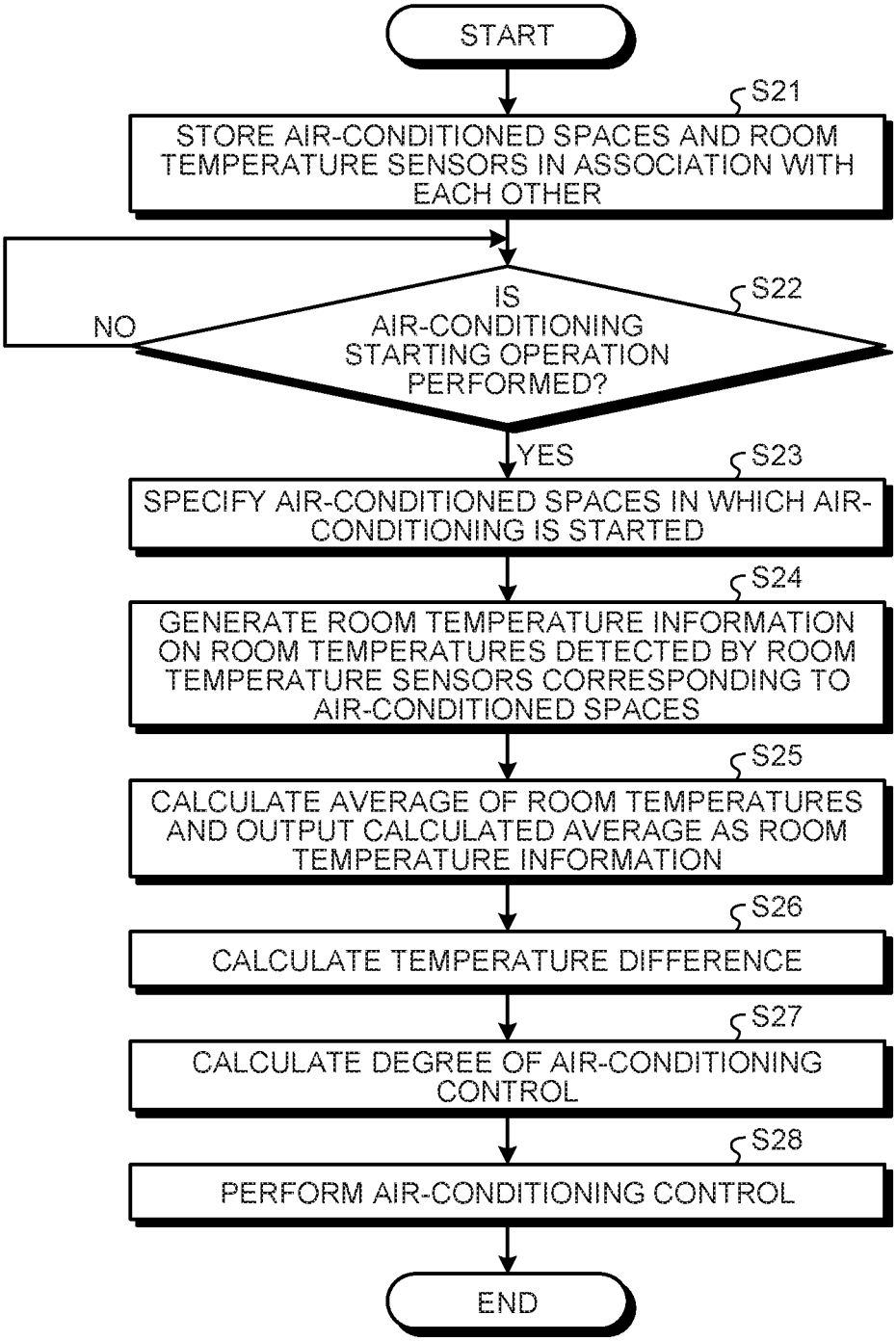
FIG. 7 is a flowchart illustrating operations of the duct type air conditioning system according to the second embodiment of the present invention.

Operations will be described below. FIG. 7 is a flowchart illustrating the operations of the duct type air conditioning system according to the second embodiment of the present invention. The room temperature sensor setting unit 62 performs the operation of setting the room temperature sensor that is used for air-conditioning control of the air-conditioned space that a user wants to air-condition, and thus the air-conditioned spaces and the room temperature sensors set by the room temperature sensor setting unit 62 are stored in association with each other in the sensor setting table 421 (step S21). When the air-conditioning operation unit 61 does not perform the air-conditioning starting operation on the air-conditioned spaces 10-1, 10-2, 10-3, and 10-4 (step S22, No), the air-conditioned space specifying unit 422 continues to perform the process of step S22. For example, when the air-conditioning operation unit 61 performs the air-conditioning starting operation on the air-conditioned spaces 10-1 and 10-3 (step S22, Yes), the air-conditioned space specifying unit 422 specifies the air-conditioned spaces 10-1 and 10-3 in which air-conditioning is started (step S23), the room temperature information generating unit 423 determines the room temperature sensor 11-1 corresponding to the air-conditioned space 10-1 and the room temperature sensor 11-3 corresponding to the air-conditioned space 10-3 by referring to the sensor setting table 421 and generates the room temperature information on the room temperatures detected by the determined room temperature sensors (step S24), and the average temperature calculating unit 426 calculates the average temperature of the room temperatures by using the room temperature information on the room temperatures generated by the room temperature information generating unit 423 (step S25).

Figures 8, 9:
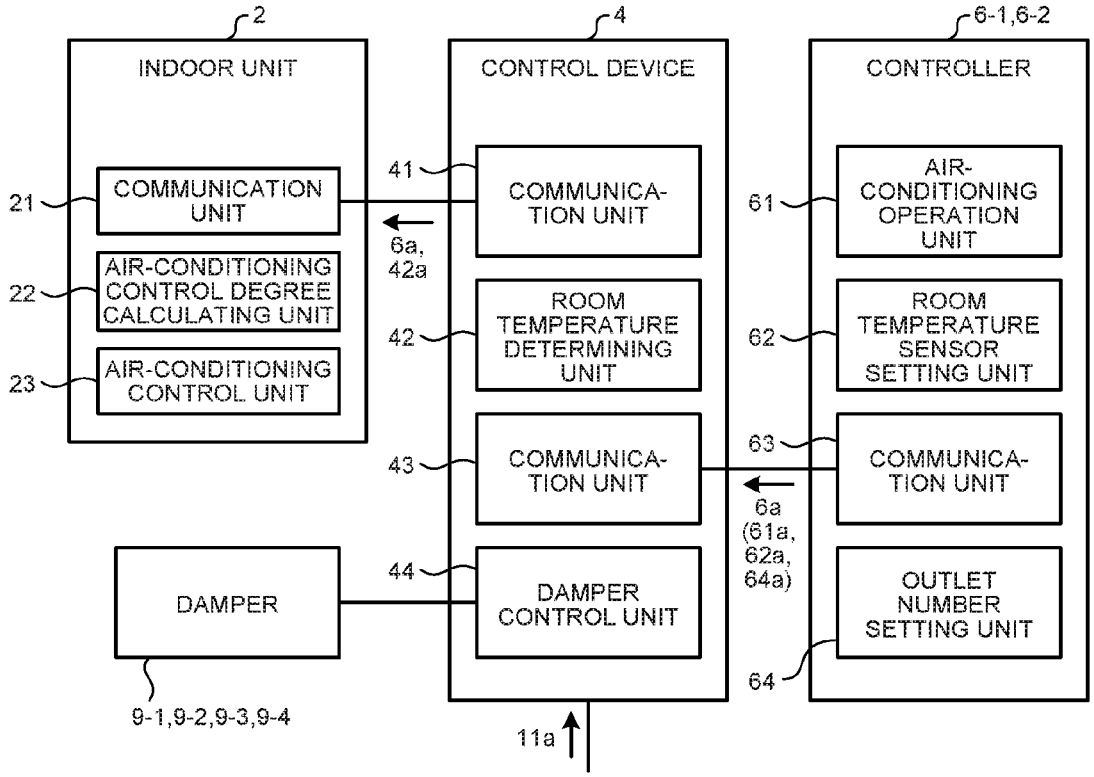
FIG. 8 is a diagram illustrating the room temperatures that are detected by the room temperature sensors disposed in the air-conditioned spaces set in the sensor setting table and the states of the air-conditioning starting operation of the air-conditioned spaces.
FIG. 9 is a diagram illustrating functional blocks of an indoor unit, a control device, and a controller that constitute a duct type air conditioning system according to a third embodiment of the present invention.

FIG. 8 is a diagram illustrating the room temperatures that are detected by the room temperature sensors disposed in the air-conditioned spaces set in the sensor setting table and the states of the air-conditioning starting operation of the air-conditioned spaces. FIG. 8 illustrates the correspondence relation between the air-conditioned spaces 10-1, 10-2, 10-3, and 10-4 and the room temperature sensors 11-1, 11-2, 11-3, and 11-4, which is set in the sensor setting table 421. In FIG. 8, the room temperatures detected by the room temperature sensors 11-1, 11-2, 11-3, and 11-4 and the ON/OFF state indicating whether the air-conditioning starting operation is performed by the air-conditioning operation unit 61 are illustrated. In the above-mentioned example, because the air-conditioning operation unit 61 has performed the air-conditioning starting operation on the air-conditioned spaces 10-1 and 10-3, ON is described for the air-conditioned spaces 10-1 and 10-3 and OFF is described for the air-conditioned spaces 10-2 and 10-4 in the box of air-conditioning starting operation in FIG. 8. Because the room temperatures detected by the room temperature sensors 11-1 and 11-3 disposed in the air-conditioned spaces 10-1 and 10-3 are 24° C. and 26° C. respectively, the average temperature calculated by the average temperature calculating unit 426 is 25° C.

The air-conditioning control degree calculating unit 22 calculates the temperature difference between the average temperature calculated by the room temperature determining unit 42 and the set temperature of the air-conditioned space by using the room temperature information 42*a* from the room temperature determining unit 42 and the controller output information 6*a* (step S26) and calculates the degree of air-conditioning control of the air conditioner corresponding to the temperature difference (step S27), and the air-conditioning control unit 23 performs the air-conditioning control in accordance with the degree of air-conditioning control (step S28).

As described above, the control device according to the second embodiment determines the room temperature sensors disposed in the air-conditioned spaces on which the air-conditioning starting operation is performed by the controller, and the air conditioner calculates the degree of control of the air conditioner on the basis of the average temperature of the room temperatures detected by the room temperature sensors determined by the control device. By employing this configuration, when a plurality of air-conditioned spaces are simultaneously air-conditioned, the duct type air conditioning system 1 can automatically perform air-conditioning control by using the room temperatures detected by the room temperature sensors disposed in the air-conditioned spaces on which the air-conditioning starting operation is performed. Accordingly, it is possible to improve user convenience, to perform the air-conditioning control without being biased to a specific room temperature sensor, and thus to achieve an improvement in user comfort.

Third Embodiment

While the second embodiment describes a configuration example in which the air-conditioning control is carried out by using the average temperature of the room temperatures detected by the room temperature sensors when air-conditioning is simultaneously started in a plurality of air-conditioned spaces, a third embodiment will describe a configuration example in which air-conditioning control is performed by using room temperatures that are weighted to correspond to the number of outlets. In the following description, the same elements as in the first embodiment will be referenced by the same reference signs, description thereof will not be repeated, and only differences therebetween will be described below.

FIG. 9 is a diagram illustrating functional blocks of an indoor unit, a control device, and a controller that constitute a duct type air conditioning system according to the third embodiment of the present invention. The third embodiment is different from the first embodiment, in that each of the controllers 6-1 and 6-2 includes an outlet number setting unit 64 that sets the number of outlets disposed in a plurality of air-conditioned spaces in addition to the air-conditioning operation unit 61, the room temperature sensor setting unit 62, and the communication unit 63. Outlet number information 64*a* set by the outlet number setting unit 64 is included in the controller output information 6*a* and is transmitted to the room temperature determining unit 42 via the communication unit 63 and the communication unit 43.

Figure 10:
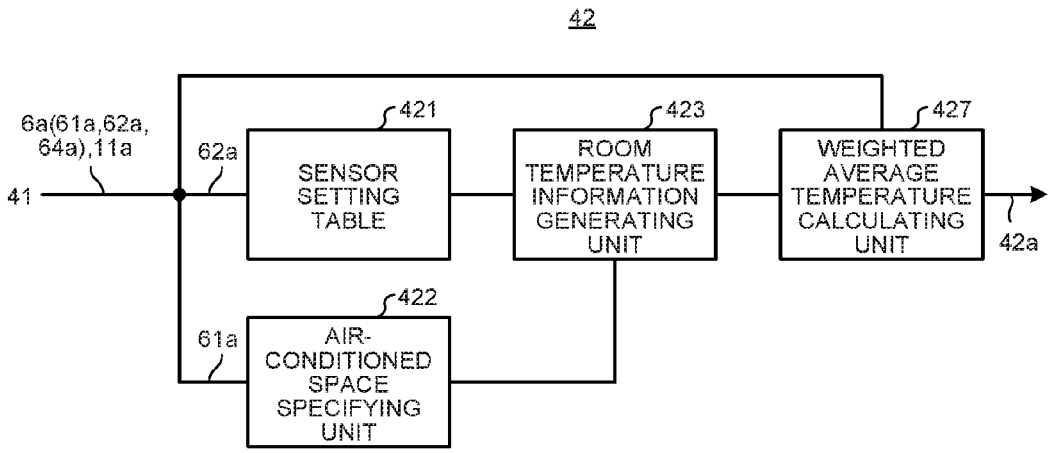
FIG. 10 is a diagram illustrating a functional block of a room temperature determining unit illustrated in FIG. 9.

FIG. 10 is a diagram illustrating a functional block of the room temperature determining unit illustrated in FIG. 9. The room temperature determining unit 42 illustrated in FIG. 10 includes the sensor setting table 421, the air-conditioned space specifying unit 422, the room temperature information generating unit 423, and a weighted average temperature calculating unit 427 that calculates the temperature obtained by performing weighted-averaging on the room temperatures detected by a plurality of room temperature sensors and generated by the room temperature information generating unit 423 on the basis of the outlet number information 64*a*. The weighted average temperature calculated by the weighted average temperature calculating unit 427 is output as the room temperature information 42*a*.

The weighted average temperature calculating unit 427 calculates the weighted average temperature as follows. Here, n denotes the number of outlets disposed in the air-conditioned spaces in which air-conditioning is started, T denotes the temperature detected by the room temperature sensor disposed in the air-conditioned space in which air-conditioning is started, and N denotes the total of the outlets in the air-conditioned spaces in which air-conditioning is started.

$$\text{Weighted average temperature}=\Sigma(n\times T)/N$$

Figure 11:
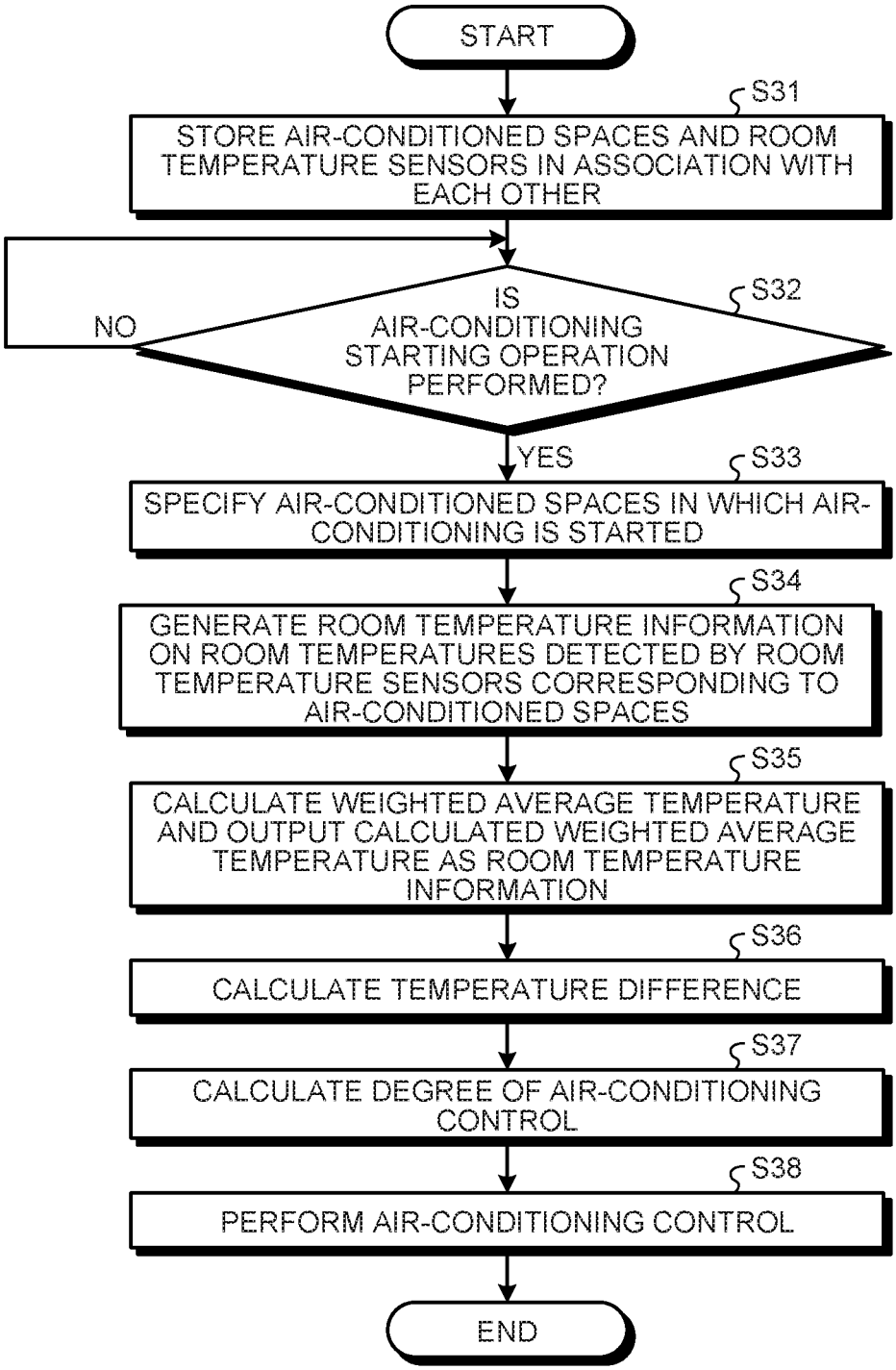
FIG. 11 is a flowchart illustrating operations of the duct type air conditioning system according to the third embodiment of the present invention.

Operations will be described below. FIG. 11 is a flowchart illustrating the operations of the duct type air conditioning system according to the third embodiment of the present invention. The room temperature sensor setting unit 62 performs the operation of setting the room temperature sensor that is used for air-conditioning control of the air-conditioned space that a user wants to air-condition, and thus the air-conditioned spaces and the room temperature sensors set by the room temperature sensor setting unit 62 are stored in association with each other in the sensor setting table 421 (step S31). When the air-conditioning operation unit 61 does not perform the air-conditioning starting operation on the air-conditioned spaces 10-1, 10-2, 10-3, and 10-4 (step S32, No), the air-conditioned space specifying unit 422 continues to perform the process of step S32. For example, when the air-conditioning operation unit 61 performs the air-conditioning starting operation on the air-conditioned spaces 10-1 and 10-3 (step S32, Yes), the air-conditioned space specifying unit 422 specifies the air-conditioned spaces 10-1 and 10-3 in which air-conditioning is started (step S33), and the room temperature information generating unit 423 determines the room temperature sensor 11-1 corresponding to the air-conditioned space 10-1 and the room temperature sensor 11-3 corresponding to the air-conditioned space 10-3 by referring to the sensor setting table 421 and generates the room temperature information on the room temperatures detected by the determined room temperature sensors (step S34).

The weighted average temperature calculating unit 427 calculates the temperature obtained by performing weighted-averaging on the room temperatures by using the room temperature information on the room temperatures generated by the room temperature information generating unit 423 (step S35). For example, when the room temperature detected by the room temperature sensor 11-1 is 24° C., the room temperature detected by the room temperature sensor 11-3 is 26° C., the number of outlets disposed in the air-conditioned space 10-1 is four, and the number of outlets disposed in the air-conditioned space 10-3 is three, the weighted average temperature is 25° C.

The air-conditioning control degree calculating unit 22 calculates the temperature difference between the weighted average temperature calculated by the room temperature determining unit 42 and the set temperature of the air-conditioned space by using the room temperature information 42*a* from the room temperature determining unit 42 and the controller output information 6*a* (step S36) and calculates the degree of air-conditioning control of the air conditioner corresponding to the temperature difference (step S37), and the air-conditioning control unit 23 performs the air-conditioning control in accordance with the degree of air-conditioning control (step S38).

As described above, the control device according to the third embodiment determines the room temperature sensors disposed in the air-conditioned spaces on which the air-conditioning starting operation is performed by the controller and performs weighted-averaging on the room temperatures detected by the room temperature sensors determined by the control device by using the number of outlets disposed at the ends of the ducts, and the air conditioner calculates the degree of control of the air conditioner on the basis of the temperature obtained by performing weighted averaging. By employing this configuration, the duct type air conditioning system 1 can achieve the same advantageous effects as in the second embodiment and can also cause the room temperature of the air-conditioned space that is not likely to be air-conditioned to more rapidly approach the set temperature, thereby achieving further improvement in user comfort.

Fourth Embodiment

While the third embodiment describes a configuration example in which the air-conditioning control is carried out by using the room temperatures weighted to correspond to the number of outlets, a fourth embodiment will describe a configuration example in which priority levels are given to a plurality of air-conditioned spaces and the air-conditioning control is preferentially performed on the air-conditioned space having a high priority level. In the following description, the same elements as in the first embodiment will be referenced by the same reference signs, description thereof will not be repeated, and only differences therebetween will be described below.

Figure 12:
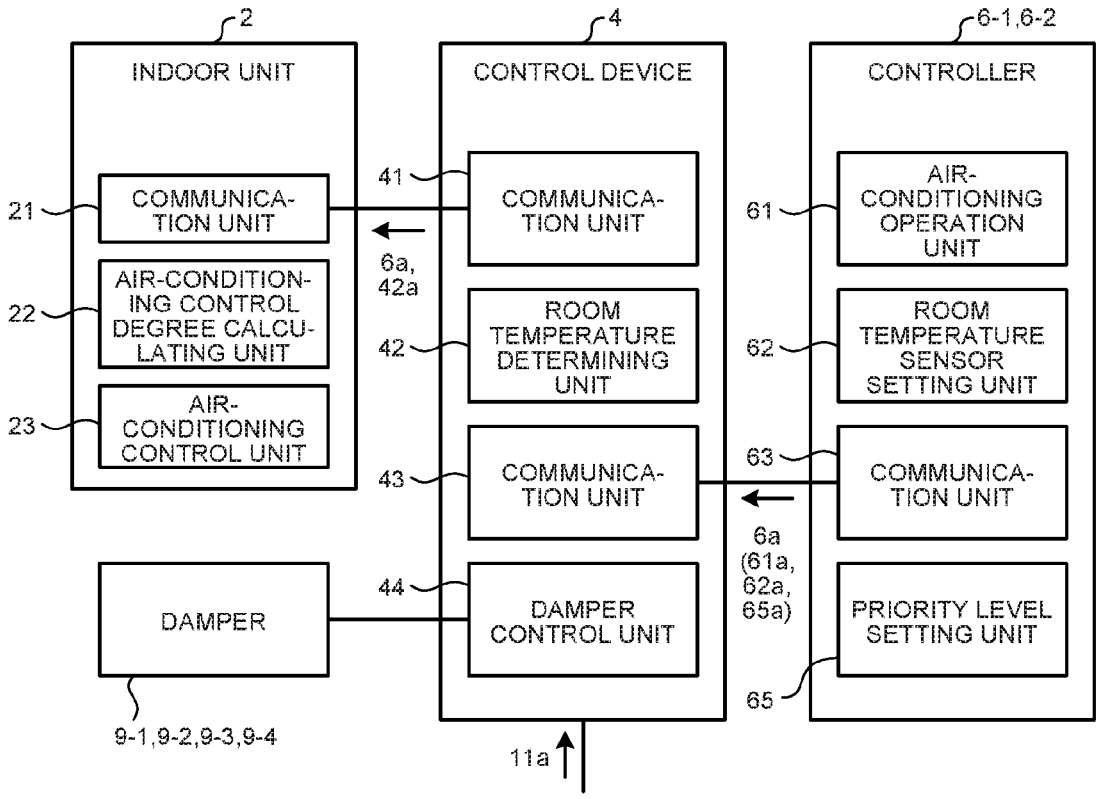
FIG. 12 is a diagram illustrating functional blocks of an indoor unit, a control device, and a controller that constitute a duct type air conditioning system according to a fourth embodiment of the present invention.

FIG. 12 is a diagram illustrating functional blocks of an indoor unit, a control device, and a controller that constitute a duct type air conditioning system according to the fourth embodiment of the present invention. The fourth embodiment is different from the first embodiment, in that each of the controllers 6-1 and 6-2 includes a priority level setting unit 65 that sets priority levels of a plurality of air-conditioned spaces in addition to the air-conditioning operation unit 61, the room temperature sensor setting unit 62, and the communication unit 63. Priority level information 65*a* set by the priority level setting unit 65 is included in the controller output information 6*a* and is transmitted to the room temperature determining unit 42 via the communication unit 63 and the communication unit 43.

Figure 13:
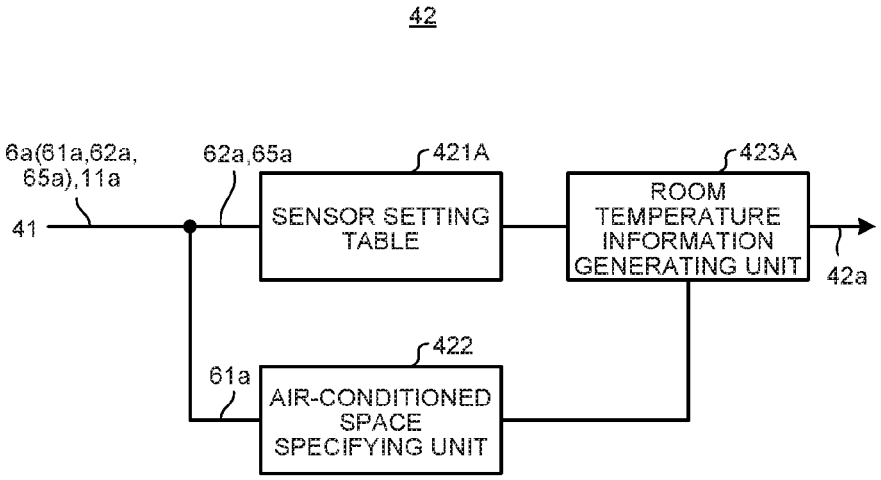
FIG. 13 is a diagram illustrating a functional block of a room temperature determining unit illustrated in FIG. 12.

FIG. 13 is a diagram illustrating a functional block of the room temperature determining unit illustrated in FIG. 12. The room temperature determining unit 42 illustrated in FIG. 13 includes a sensor setting table 421A in which the air-conditioned spaces, the room temperature sensors set by the room temperature sensor setting unit 62, and the priority levels of the air-conditioned spaces are stored in association with each other on the basis of the room temperature sensor setting information 62*a* and the priority level information 65*a*; the air-conditioned space specifying unit 422; and a room temperature information generating unit 423A that determines the room temperature sensor corresponding to the air-conditioned space having the highest priority level out of the air-conditioned spaces specified by the air-conditioned space specifying unit 422 by referring to the sensor setting table 421A and generates room temperature information on the room temperature detected by the determined room temperature sensor. The room temperature generated by the room temperature information generating unit 423A is output as the room temperature information 42*a*.

FIG. 14 is a diagram illustrating an example of the sensor setting table illustrated in FIG. 13. In the sensor setting table 421A, for example, the air-conditioned spaces 10-1, 10-2, 10-3, and 10-4, the room temperature sensors 11-1, 11-2, 11-3, and 11-4, and the priority levels of 1 to 4 are stored in association with each other. Specifically, in the sensor setting table 421A, it is assumed that the air-conditioned space 10-1, the room temperature sensor 11-1, and the priority level "4" are associated, the air-conditioned space 10-2, the room temperature sensor 11-2, and the priority level "3" are associated, the air-conditioned space 10-3, the room temperature sensor 11-3, and the priority level "2" are associated, and the air-conditioned space 10-4, the room temperature sensor 11-4, and the priority level "1" are associated. In the illustrated example, it is assumed that the priority level "1" is the highest and the priority level "4" is the lowest.

Figure 15:
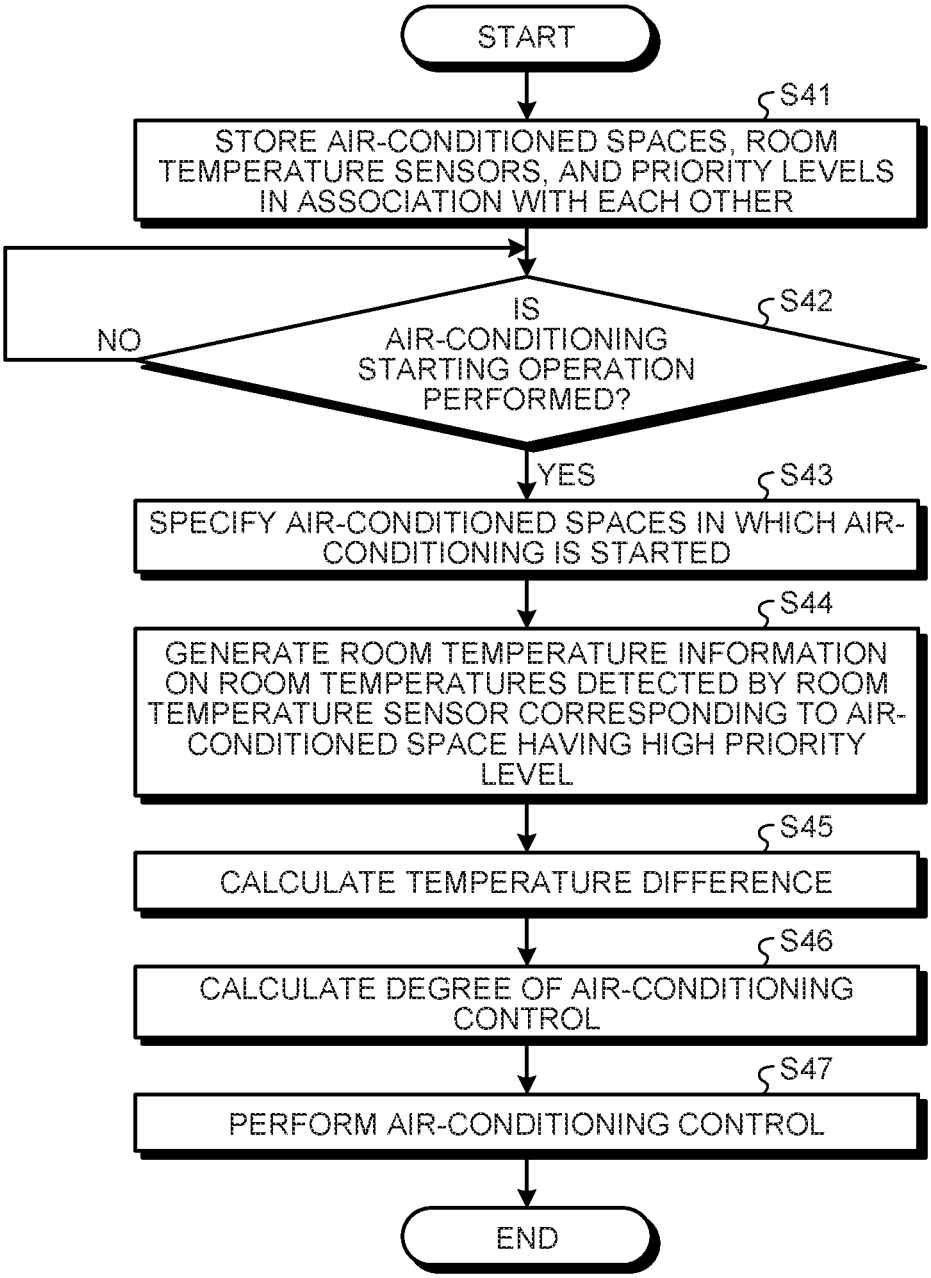
FIG. 15 is a flowchart illustrating operations of the duct type air conditioning system according to the fourth embodiment of the present invention.

Operations will be described below. FIG. 15 is a flowchart illustrating the operations of the duct type air conditioning system according to the fourth embodiment of the present invention. The room temperature sensor setting unit 62 performs the operation of setting the room temperature sensor that is used for air-conditioning control of the air-conditioned space that a user wants to air-condition. The priority level setting unit 65 performs an operation of setting the priority levels of the air-conditioned spaces. Accordingly, the air-conditioned spaces, the room temperature sensors, and the priority levels are stored in association with each other in the sensor setting table 421A (step S41). When the air-conditioning operation unit 61 does not perform the air-conditioning starting operation on the air-conditioned spaces 10-1, 10-2, 10-3, and 10-4 (step S42, No), the air-conditioned space specifying unit 422 continues to perform the process of step S42. For example, when the air-conditioning operation unit 61 performs the air-conditioning starting operation on the air-conditioned spaces 10-1 and 10-3 (step S42, Yes), the air-conditioned space specifying unit 422 specifies the air-conditioned spaces 10-1 and 10-3 in which air-conditioning is started (step S43), and the room temperature information generating unit 423A determines the room temperature sensor 11-3 corresponding to the air-conditioned space 10-3 having a priority level higher than that of the air-conditioned space 10-1 by referring to the sensor setting table 421A and generates the room temperature information 42*a* on the room temperature detected by the determined room temperature sensor 11-3 (step S44). The air-conditioning control degree calculating unit 22 calculates the temperature difference between the room temperature determined by the room temperature determining unit 42 and the set temperature of the air-conditioned space 10-3 by using the room temperature information 42*a* from the room temperature determining unit 42 and the controller output information 6*a* (step S45) and calculates the degree of air-conditioning control of the air conditioner corresponding to the temperature difference (step S46), and the air-conditioning control unit 23 performs the air-conditioning control in accordance with the degree of air-conditioning control (step S47).

As described above, in the duct type air conditioning system 1 according to the fourth embodiment, the air-conditioned spaces, the room temperature sensors, and the priority levels of the air-conditioned spaces are associated with each other in the sensor setting information, the control device determines the room temperature sensor having a higher priority level out of the room temperature sensors disposed in the air-conditioned spaces on which the air-conditioning starting operation is performed by the controller, and the air conditioner calculates the degree of control of the air conditioner on the basis of the room temperature detected by the room temperature sensor determined by the control device. By employing this configuration, the duct type air conditioning system 1 can achieve the same advantageous effects as in the first embodiment and can also preferentially air-condition an air-conditioned space desired by a user when the air-conditioned spaces are simultaneously air-conditioned, thereby achieving further improvement in user comfort.

The air conditioners according to the second, third, and fourth embodiments may be configured to have a function of selecting the operation of calculating the degrees of control of the air conditioners according to the second, third, and fourth embodiments when the air-conditioning starting operation of a plurality of air-conditioned spaces is performed by the controller. According to this configuration, air-conditioning control suitable for the environment of a user can be selected by using a single air conditioner and it is thus possible to achieve further improvement in user convenience.

As described above, the duct type air conditioning system according to any one of the first, second, third, and fourth embodiments includes an air conditioner, a plurality of ducts that are disposed in a plurality of air-conditioned spaces that are supplied with conditioned air of the air conditioner, a plurality of room temperature sensors that are disposed in the air-conditioned spaces, a control device that controls the air conditioner, and a controller that controls the air conditioner. The control device determines the room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning control degree calculating unit that calculates a degree of control of the air conditioner on the basis of the room temperature detected by the room temperature sensor determined by the control device. According to this configuration, even when a plurality of air-conditioned spaces are simultaneously air-conditioned, it is possible to automatically carry out the air-conditioning control by using the room temperature detected by the room temperature sensor disposed in the air-conditioned space in which the air-conditioning starting operation is performed and it is thus possible to achieve improvement in user convenience.

The configurations illustrated in the above embodiments are examples of the content of the present invention and can be combined with other publicly known technologies, and a part of the configurations can be removed or modified without departing from the gist of the present invention.

The invention claimed is:

1. A duct type air conditioning system comprising:

an air conditioner;

a plurality of ducts that are disposed in a plurality of air-conditioned spaces that are supplied with conditioned air of the air conditioner;

a plurality of room temperature sensors that are disposed in the air-conditioned spaces;

a control device having a processor configured to control the air conditioner; and a controller that performs an air-conditioning operation on the air conditioner, wherein the processor of the control device is configured to determine a room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning processor configured to:

calculate a degree of control of the air conditioner on a basis of a room temperature detected by the room temperature sensor determined by the processor of the control device, wherein the degree of control is based on a difference between the detected room temperature and a set temperature, set by the controller, of the one of the air-conditioned spaces which is associated with the room temperature sensor, and control a supply amount of conditioned air in accordance with the calculated degree of control.

2. A duct type air conditioning system comprising:

an air conditioner;

a plurality of ducts that are disposed in a plurality of air-conditioned spaces that are supplied with conditioned air of the air conditioner;

a plurality of room temperature sensors that are disposed in the air-conditioned spaces;

a control device having a processor configured to control the air conditioner; and a controller that performs an air-conditioning operation on the air conditioner, wherein the processor of the control device is configured to determine a room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning processor configured to calculate a degree of control of the air conditioner on a basis of a room temperature detected by the room temperature sensor determined by the processor of the control device, wherein the processor of the control device is further configured to determine a plurality of room temperature sensors disposed in the air-conditioned spaces on which the air-conditioning starting operation is performed by the controller, and the air conditioning processor is further configured to calculate a degree of control of the air conditioner on a basis of an average temperature of room temperatures detected by the room temperature sensors determined by the processor of the control device.

3. The duct type air conditioning system according to claim 2, wherein the processor of the control device is further configured to determine the room temperature sensor by using a sensor setting table in which the air-conditioned spaces and the room temperature sensors are associated with each other.

4. The duct type air conditioning system according to claim 2, wherein the air conditioning processor is further configured to select an operation of calculating a degree of control of the air conditioner when the air-conditioning starting operation is performed on the air-conditioned spaces by the controller.

5. A duct type air conditioning system comprising:

an air conditioner;

a plurality of ducts that are disposed in a plurality of air-conditioned spaces that are supplied with conditioned air of the air conditioner;

a plurality of room temperature sensors that are disposed in the air-conditioned spaces;

a control device having a processor configured to control the air conditioner; and a controller that performs an air-conditioning operation on the air conditioner, wherein the processor of the control device is configured to determine a room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning processor configured to calculate a degree of control of the air conditioner on a basis of a room temperature detected by the room temperature sensor determined by the processor of the control device, wherein the processor of the control device is further configured to determine a plurality of room temperature sensors disposed in the air-conditioned spaces on which the air-conditioning starting operation is performed by the controller and perform weighted-averaging on room temperatures detected by the determined room temperature sensors by using number of outlets disposed at ends of the ducts, and the air conditioning processor is further configured to calculate a degree of control of the air conditioner on a basis of a temperature obtained by performing weighted-averaging by the processor of the control device.

6. The duct type air conditioning system according to claim 5, wherein the air conditioning processor is further configured to select an operation of calculating a degree of control of the air conditioner when the air-conditioning starting operation is performed on the air-conditioned spaces by the controller.

7. The duct type air conditioning system according to claim 5, wherein the processor of the control device is further configured to determine the room temperature sensor by using a sensor setting table in which the air-conditioned spaces and the room temperature sensors are associated with each other.

8. A duct type air conditioning system comprising:

an air conditioner;

a plurality of ducts that are disposed in a plurality of air-conditioned spaces that are supplied with conditioned air of the air conditioner;

a plurality of room temperature sensors that are disposed in the air-conditioned spaces;

a control device having a processor configured to control the air conditioner; and a controller that performs an air-conditioning operation on the air conditioner, wherein the processor of the control device is configured to determine a room temperature sensor disposed in any of the air-conditioned spaces on which an air-conditioning starting operation is performed by the controller by using sensor setting information in which the air-conditioned spaces and the room temperature sensors are associated with each other, and the air conditioner includes an air-conditioning processor configured to calculate a degree of control of the air conditioner on a basis of a room temperature detected by the room temperature sensor determined by the processor of the control device, wherein the air-conditioned spaces, the room temperature sensors, and priority levels of the air-conditioned spaces are associated with each other in the sensor setting information, the processor of the control device is further configured to determine a room temperature sensor having a higher priority level out of the room temperature sensors disposed in the air-conditioned spaces on which the air-conditioning starting operation is performed by the controller, and the air conditioning processor is further configured to calculate a degree of control of the air conditioner on a basis of a room temperature detected by the room temperature sensor determined by the processor of the control device.

9. The duct type air conditioning system according to claim 8, wherein the air conditioning processor is further configured to select an operation of calculating a degree of control of the air conditioner when the air-conditioning starting operation is performed on the air-conditioned spaces by the controller.

10. The duct type air conditioning system according to claim 8, wherein the processor of the control device is further configured to determine the room temperature sensor by using a sensor setting table in which the air-conditioned spaces and the room temperature sensors are associated with each other.

* * * * *